United States Patent [19]

Knepper et al.

[11] Patent Number: 4,515,603

[45] **Date of Patent: * May 7, 1985**

[54] ANTI-STATIC COMPOSITIONS

[75] Inventors: J. Irvine Knepper, Manchester; Dennis C. Sallee, St. Louis, both of Mo.

[73] Assignee: Petrolite Corporation, St. Louis, Mo.

[ * ] Notice: The portion of the term of this patent subsequent to Oct. 26, 1999 has been disclaimed.

[21] Appl. No.: 418,111

[22] Filed: Sep. 14, 1982

Related U.S. Application Data

[62] Division of Ser. No. 968,327, Dec. 11, 1978, Pat. No. 4,356,002.

[51] Int. Cl.[3] ..... C10L 1/14

[52] U.S. Cl. ..... 44/62

[58] Field of Search ..... 44/62, 77, 51; 252/331, 252/8.6; 260/DIG. 17, DIG. 19

[56] References Cited

U.S. PATENT DOCUMENTS

| | | | |
|---|---|---|---|
| 2,499,365 | 3/1950 | DeGroote et al. | 528/3 |
| 2,499,368 | 3/1950 | DeGroote et al. | 252/331 |
| 2,729,576 | 1/1956 | Trusler | 8/142 |
| 3,042,479 | 7/1962 | Lawrence, Jr. et al. | 252/172 |
| 3,396,115 | 8/1968 | Moore | 252/171 |
| 3,467,487 | 9/1969 | Kirschnek et al. | 8/115.6 |
| 3,628,911 | 12/1971 | Grunewalder | 252/170 |
| 3,926,831 | 12/1975 | Sonnengrüber | 8/142 |
| 3,956,162 | 5/1976 | Lautenberger | 252/167 |
| 3,959,155 | 5/1976 | Montgomery et al. | 252/120 |
| 4,029,480 | 6/1977 | Johnston | 44/62 |
| 4,113,443 | 9/1978 | Spence | 44/72 |

*Primary Examiner*—Y. Harris-Smith

*Attorney, Agent, or Firm*—Sidney B. Ring; Leon Zitver

[57] ABSTRACT

This invention relates to use of surfactants, such as demulsifiers as illustrated by oxyalkylated phenol-aldehyde resins, as antistatic agents in organic fluids such as hydrocarbon fuels. These surfactants are also capable of synergistically enhancing the effect of other antistatic agents.

6 Claims, No Drawings

ANTI-STATIC COMPOSITIONS

This is a division of application Ser. No. 968,327 filed Dec. 11, 1978 now U.S. Pat. No. 4,356,002.

This invention relates to organic liquids having desirable anti-static properties, and, in one of its aspects, relates more particularly to organic liquid compositions in the form of volatile organic liquids such as hydrocarbon fuels or solvents which possess low electrical conductivity which, when they accumulate electrostatic charges, may give rise to the hazards of ignition or explosion. Still more particularly in this aspect, the invention relates to the improvement of such organic liquids by incorporating therein, additives which are effective in increasing the electrical conductivity of such liquids to the extent that accumulation of electrostatic charges, with attendant danger of ignition or explosion, is significantly minimized, particularly in the handling, transportation or treatment of such liquids.

The low electrical conductivity of many volatile organic liquid compositions has presented the problem of controlling static buildup, particularly during handling and transportation, for the purpose of insuring safe and effective distribution without the concomitant danger of ignition or explosion. For example, volatile organic liquids such as hydrocarbon fuels (e.g. fuel oil, kerosine, jet fuels, turbine fuels and the like), or light hydrocarbon oils employed for such purposes as solvents or cleaning fluids for textiles, possess a very low degree of electrical conductivity. In the use of such fluids, electrostatic charges, which may be generated by handling (filtering, pumping), operation or other means, tend to form by charge separation, and may accumulate in areas of the fluid isolated from ground if the fluid has low electrical conductivity. If these charges accumulate and result in significant surface voltages an incendiary discharge between the fluid surface and a grounded object such as a vessel wall or delivery tube, a probe, etc. If the vapor space contains a flammable mixture an explosion may occur. These hazards may be encountered merely in the handling or transportation of such organic liquids and even in operations, such as centrifuging, in which a solid is separated from a volatile liquid, during which electrostatic charges can accumulate.

Various materials have heretofore been proposed for incorporation into such organic liquid compositions for increasing their electrical conductivity and thus reduce the aforementioned dangers of ignition and explosion by permitting electrostatic charges to dissipate safely through the fluid.

The following are examples of patents which describe anti-static agents employed in fuels:

(1) α-olefin-sulfone copolymers
- U.S Pat. No. 3,578,421
- U.S. Pat. No. 3,677,724
- U.S. Pat. No. 3,807,977
- U.S. Pat. No. 3,811,848
- U.S. Pat. No. 3,917,466

(2) α-olefin-maleic anhydride copolymers
- U.S. Pat. No. 3,677,725

(3) amines and methyl vinyl ether-maleic anhydride copolymers
- U.S. Pat. No. 3,578,421

(4) aliphatic amines-fluorinated Polyolefins
- U.S. Pat. No. 3,652,238

(5) chromium salts and amine phosphates U.S. Pat. No. 3,758,283

In application Ser. No. 810,342 filed June 27, 1977, now Pat. No. 4,333,741, there is discovered and claimed a new class of copolymers, namely, α-olefin-acrylonitrile copolymers which are useful as antistatic agents, particularly as antistatic agents in organic fluids such as in hydrocarbon fuels.

The polymers of Ser. No. 810,342 are copolymers of acrylonitrile and an α-olefin ideally presented as follows:

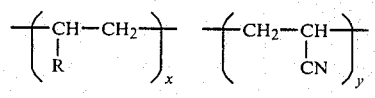

where R is a substitute group such as an alkyl group having from about 4–26 or more carbons, for example, from about 4 to 20, but preferably from about 8 to 18 carbon atoms; an aryl or a substituted aryl group such as a phenyl or a substituted phenyl group such as an alkyl phenyl, the alkyl group having from about 1 to 26 carbon atoms, such as from about 1 to 20 carbon atoms, but preferably from about 1 to 16 carbon atoms. The ratio of acrylonitrile to α-olefin, i.e., y:x, can vary widely, for example from about 1:1 to 5:1 but for example from about 1:1 to 4:1, but preferably from about 2:1 to 4:1. The molecular weight of the copolymer can vary widely such as from about 1,000 to 100,000 or more, for example from about 1,500 to 50,000, but preferably from about 2,000 to 10,000.

Ser. No. 954,512 filed Oct. 25, 1978 describes and claims α-olefin-maleimide copolymers and blends of said α-olefin-maleimide copolymers and α-olefin-sulfur dioxide copolymers are excellent antistatic agents, particularly when incorporated into an organic liquid such as a hydrocarbon fuel.

The α-olefin-maleimide copolymers are compositions ideally presented as containing the following polymer unit:

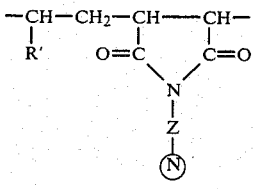

where R′ is the moiety of the α-olefin such as alkyl, etc. and Z represents the moiety of the dangling group having a terminal amino group represented by Ⓝ.

The combination of olefin polysulfone and an α-olefinmaleimide copolymer, at very low concentrations, provide high initial conductivity as well as long-lasting conductivity. Concentrations as low as a few tenths of part per million (ppm) have been found sufficient to demonstrate increased conductivity. It is wholly unexpected and surprising that the combination of olefin polysulfone and α-olefin-maleimide copolymer exhibits conductivity significantly greater than that attributable to each of the individual components of the combination and that the conductivity of the treated fuels continues to increase with time.

The ratio of olefin polysulfone to α-olefin-maleimide copolymer may be from about 100:1 to about 1:100, preferably in the range of from about 50:1 to about 1:1, most preferably in the range of from about 20:1 to about 1:1. The most preferred ratios afford compositions which are economical to use, are effective in increasing conductivity and do not adversely affect other desirable characteristics of the hydrocarbon fuels. The preferred olefin polysulfone to be used in this invention is 1-decene polysulfone having an inherent viscosity in the range from about 0.1 dl/g. to 1.6 dl/g. (M.W. of 50,000 to 900,000), and the preferred α-olefin-maleimide copolymer contains the following polymeric unit:

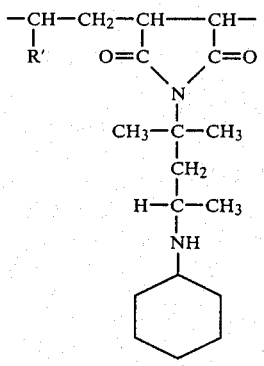

We have now discovered that surfactants, particularly those which are effective as demulsifiers, act as antistatic agents and are particularly effective in enhancing the effect of other antistatic agents, particularly when incorporated into an organic liquid such as hydrocarbon fuel.

Although any suitable surfactant can be employed as an antistatic agent, surfactants which are effective as demulsifiers are preferred. Those demulsifiers which are particularly preferred are those capable of demulsifying hydrocarbon such as petroleum emulsions.

An example of suitable demulsifier surfactants includes oxyalkylated materials such as oxyalkylated phenol-aldehyde resins.

Examples of suitable demulsifiers can be found in U.S. Pat. No. 2,499,365,-6,-7,-8, as well as other patents. Claim 1 of said patents are illustrative.

U.S. Pat. No. 2,499,365

"1. A process for breaking petroleum emulsions of the water-in-oil type characterized by subjecting the emulsion to the action of a demulsifier including a hydrophile oxyalkylated synthetic resin; said synthetic resin being one in which the ratio of oxyalkylene groups to structural units is at least 2 to 1 and the alkylene radicals of the oxyalkylene groups are selected from the group consisting of ethylene, propylene, butylene, hydroxy propylene and hydroxy butylene radicals."

U.S. Pat. No. 2,499,366

"1. A process for breaking petroleum emulsions of the water-in-oil type characterized by subjecting the emulsion to the action of a demulsifier including a hydrophile oxyalkylated phenolic resin; said phenolic resin being in which a phenol supplies a resinogen radical by virtue of a nuclear hydrogen atom; said resin being one in which the ratio of oxyalkylene groups to phenolic nuclei is at least 2:1 and the alkylene radicals of the oxyalkylene groups are selected from the group consisting of ethylene, propylene, butylene, hydroxy propylene and hydroxy butylene radicals."

U.S. Pat. No. 2,499,367

"1. A process for breaking petroleum emulsions of the water-in-oil type characterized by subjecting the emulsion to the action of a demulsifier including a hydrophile oxyalkylated 2,4,6 substituted monocyclic phenol $C_1$- to $C_8$-aldehyde resin in which the ratio of oxyalkylene groups to phenolic nuclei is at least 2:1 and the alkylene radicals of the oxyalkylene groups are selected from the group consisting of ethylene, propylene, butylene, hydroxy propylene and hydroxy butylene radicals."

U.S. Pat. No. 2,499,368

"1. A process for breaking petroleum emulsions of the water-in-oil type characterized by subjecting the emulsion to the action of a demulsifier including a hydrophile oxyalkylated 2,4,6 $C_1$- to $C_{24}$-hydrocarbon substituted monocyclic phenol—$C_1$- to $C_8$-aldehyde resin in which the ratio of oxyalkylene groups to phenolic nuclei is at least 2:1 and the alkylene radicals of the oxyalkylene groups are selected from the group consisting of ethylene, propylene, butylene, hydroxypropylene and hydroxybutylene radicals."

The preferred demulsifier employed in this invention is an oxyalkylated phenol-aldehyde resin. These may be defined as a hydrophile oxyalkylated 2,4,6 (i.e., 2, 4 or 6) $C_4$- to $C_{12}$-hydrocarbon substituted monocyclic phenol—$C_1$- to $C_8$-aldehyde resin in which the ratio of oxyalkylene groups to phenolic nuclei is at least 2:1 and the alkylene radicals of the oxyalkylene groups are ethylene, propylene, butylene, hydroxypropylene or hydroxybutylene corresponding to the alpha-beta-alkylene oxides, ethylene oxide, alpha-beta propylene oxide, alpha-beta butylene oxide, glycide and methyl glycide.

These are illustrated by the idealized formula

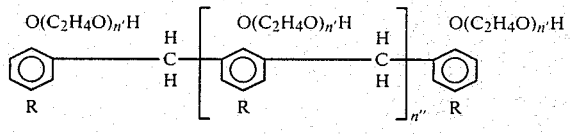

which, in turn, is considered a derivative of the fusible, organic solvent-soluble resin polymer

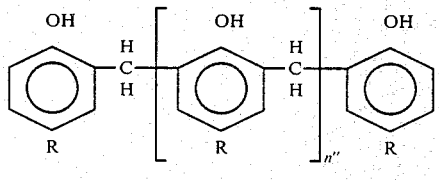

In these formulas n″ represents a numeral varying from 1 to 13 or even more, provided that the parent resin is fusible and organic solvent-soluble; n′ represents a numeral varying from 1 to 20, with the proviso that the average value of n′ be at least 2; and R is a hydrocarbon radical having at least 4 and not over 12 carbon atoms. These numerical values of n′ and n″ are on a statistical basis.

The hydrocarbon radical R may be alkyl, cycloalkyl, aryl, aralkyl, etc.

Suitable phenolic reactants include the following: Para-tertiary butyphenol; para-secondary-butylphenol; para-tertiary-amylphenol; para-secondary-amylphenol; para-tertiary-hexylphenol; para-isooctylphenol; ortho-phenylphenol; para-phenylpherol; ortho-benzylphenol; para-benzylphenol; para-cyclohexylphenol; para-decyl-phenol; para-dodecyl-phenol; para-nonyl-phenol; para-menthyl-phenol; para-beta-naphthyl-phenol; para-alpha-naphthyl-phenol; para-cumyl-phenol; phenols of the formula

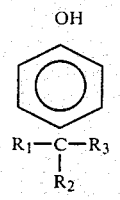

in which $R_1$ represents a straight chain hydrocarbon radical containing at least 7 carbon atoms and $R_2$ and $R_3$ represent hydrocarbon radicals, the total number of carbon atoms attached to the tertiary carbon being 11; and phenols of the formula

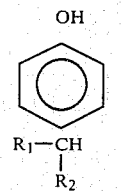

in which $R_1$ represents an alkyl hydrocarbon radical containing at least 7 carbon atoms and $R_2$ represents an alkyl hydrocarbon radical containing at least 2 carbon atoms, the total number of carbon atoms in $R_1$ and $R_2$ being 11; and the corresponding ortho-para substituted meta-cresols and 3,5-xylenols.

Any aldehyde capable of forming a methylol or a substituted methylol group and having not more than 8 carbon atoms is satisfactory, so long as it does not possess some other functional group or structure which will conflict with the resinification reaction or with the subsequent oxyalkylation of the resin, but the use of formaldehyde is preferred.

Useful aldehydes, in addition to formaldehyde, include acetaldehyde, propionaldehyde, butyraldehyde, 2-ethylhexanal ethylbutyraldehyde, heptaldehyde, and benzaldehyde, furfural, etc.

The surfactants of this invention can be employed to enhance other compositions which are effective as an antistatic agent. Non-limiting examples of such agents with which the demulsifiers of this invention can be employed have been disclosed herein, for example in Table A, Examples 5, 6, 7, 8, 9 and elsewhere.

In accordance with the present invention improved liquid hydrocarbon compositions are provided containing an amount sufficient to impart antistatic properties of the antistatic agents of this invention.

In general, the present invention, in its preferred applications contemplates organic liquid compositions which normally are capable of accumulating a relatively large degree of electrostatic charge resulting in the aforementioned hazards of ignition and explosion, having incorporated therein a small amount of the aforementioned reaction product, usually from about 0.1 to about 200, and preferably from about 1 to about 10 pounds, per thousand barrels of the total volume of the liquid composition, i.e., from about 0.1 to 100 ppm, such as from about 0.2 to 50 ppm, but preferably from about 0.5 to 10 ppm.

A field of specific applicability of the present invention is in the improvement of organic liquid compositions in the form of petroleum distillate fuel oils having an initial boiling point from about 75° F. to about 135° F. and an end boiling point from about 250° F. to about 1000° F. It should be noted, in this respect, that the term "distillate fuel oils" is not intended to be restricted to straight-run distillate fractions. These distillate fuel oils can be straight-run distillate fuel oils, catalytically or thermally cracked (including hydrocracked) distillate fuel oils, or mixtures of straight-run distillate fuel oils, naphthas and the like, with cracked distillate stocks. Moreover, such fuel oils can be treated in accordance with well-known commercial methods, such as acid or caustic treatment, hydrogenation, solvent refining, clay treatment, and the like.

The distillate fuel oils are characterized by their relatively low viscosity, pour point and the like. The principal property which characterizes these contemplated hydrocarbons, however, is their distillation range. As hereinbefore indicated, this range will lie between about 75° F. and about 1000° F. Obviously, the distillation range of each individual fuel oil will cover a narrower boiling range, falling nevertheless, within the above-specified limits. Likewise, each fuel oil will boil substantially, continuously, throughout its distillation range.

Particularly contemplated among the fuel oils are Nos. 1, 2, etc. fuel oils, used in heating and as diesel fuel oils, gasoline, turbine fuels and the jet combustion fuels, as previously indicated. The domestic fuel oils generally conform to the specifications set forth in ASTM Specification D396-73. Specifications for diesel fuels are defined in ASTM Specification D975-74. Typical jet fuels are defined in Military Specifications MIL-T-5624K, and MIL-T-83133.

Other fields of specific applicability of the present invention are: solvents, as used with paints; spot removers such as naphtha cleaners; textile compositions; pigments; liquid polishes; rubber compositions and the like. In brief, the antistatic agents of this invention can be used with a composition susceptible of accumulating a static electrical charge or a composition susceptible of generation of such a charge. Thus, a static electrical charge accumulated by such a composition can be reduced by coating a surface of the composition with one or more of the novel antistatic agents. For example, a fabric or fibre can be surface treated with one or more of the agents to reduce the susceptibility of the fabric or fibre to accumulate a static electrical charge.

The compositions of this invention, when added in concentrations of 1–100 ppm to fuel oils, increase the conductivity of the fuel substantially. Depending on the nature of the fuel and the structure of the specific demulsifier the increases in conductivity will vary. However in all cases there is a substantial increase in the conductivity of the system.

In the examples, all conductivity measurements were made with a Maihak Conductivity Indicator (H. Maihak A.G. Hamburg, Germany). In the operation, the device imposes a potential of 6 volts of direct current on a pair of chromium plated electrodes immersed in the fluid to be tested. The current resulting from this potential, which is in the order of $10^{-9}$ to $10^{-8}$ ampere, is amplified and used to activate a dial calibrated in conductivity units. A conductivity unit is 1 picomho per meter, which in turn is equal to 1 picosiemen/meter.

The effectiveness of various surfactant demulsifiers per se (i.e., when employed alone) will vary widely since not all surfactant demulsifiers will be equally effective in the same concentrations in the same fuels. In fact, in very low concentrations certain surfactant-demulsifiers will have little effectiveness or be substantially ineffective when employed alone. Therefore, in each instance, an antistatically effective amount of the surfactant demulsifier should be employed.

Although the effectiveness of the surfactant-demulsifier per se (i.e. when employed alone) will vary widely depending on the particular demulsifier, the fuel in which it is employed, etc., a sufficient amount of demulsifier per se can be employed to make it effective.

However, where the surfactant-demulsifier is employed in combination with other antistatic agents, very small amounts of surfactant-demulsifier synergistically enhance the effectiveness of other antistatic agents.

As is quite evident, other surfactants are known or will be constantly developed which could be useful in this invention. It is, therefore, not only impossible to attempt a comprehensive catalogue of such compositions, but to attempt to describe the invention in its broader aspects in terms of specific chemical names used would be too voluminous and unnecessary since one skilled in the art could by following the description of the invention herein select a useful surfactant. This invention lies in the use of suitable surfactants as antistatic agents and their individual compositions are important only in the sense that their properties can affect this function. To precisely define each specific useful surfactant in light of the present disclosure would merely call for knowledge within the skill of the art in a manner analogous to a mechanical engineer who prescribes in the construction of a machine the proper materials and the proper dimensions thereof. From the description in this specification and with the knowledge of a chemist, one will know or deduce with confidence the applicability of specific surfactants suitable for this invention by applying them as antistatic agents as set forth herein. In analogy to the case of a machine, wherein the use of certain materials of construction or dimensions thereof would lead to no practical useful result, various materials will be rejected as inapplicable where others would be operative. One can obviously assume that no one will wish to use a useless surfactant nor will be misled because it is possible to misapply the surfactants of the present disclosure to do so.

The following compositions were tested to illustrate the present invention.

TABLE A

| Composition Ex. | Compositions employed Tables I to XII |
|---|---|
| 1 | oxyethylated base-catalyzed t-butyl phenol/nonyl phenol/formaldehyde resin in solvents |
| 2 | oxyethylated acid-catalyzed t-butyl phenol/nonyl phenol/formaldehyde resin in solvents |
| 3 | oxyethylated/oxypropylated base-catalyzed t-butyl phenol/nonyl phenol/formaldehyde resin |
| 4 | oxypropylated/oxyethylated acid-catalyzed amyl phenol/formaldehyde resin |
| 5 | t-dodecylamine amide-salt of tetradecene-1/maleic anhydride copolymer (polyanhydride) in solvent |

TABLE A-continued

| Composition Ex. | Compositions employed Tables I to XII |
|---|---|
| 6 | A commercial anti-static additive which is a mixture of olefin/sulfur dioxide copolymer (polysulfone copolymer) and a polymeric polyamine derived from the reaction of an amine with epichlorohydrin in solvent |
| 7 | 1-decene/sulfur dioxide copolymer (polysulfone) |
| 8 | polymeric ester/amide made from tetradecene-1/maleic anhydride copolymer, $C_{18}$ alcohol, and N—cyclohexyl-2,4-diamino-2-methyl penta |
| 9 | A commercial antistatic additive which is a mixture of equal parts of chromium alkylsalicylate, calcium didecyl sulfosuccinate, and a copolymer of two methacrylates and methyl vinyl pyridine |

The compositions of Table A 5, 6, 7, 8, 9 are as follows:

Composition 5 has the general formula

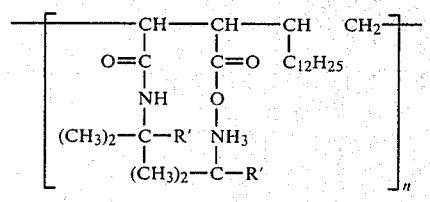

$R' = C_9H_{19}$

Composition 6 is a 1-decene/sulfur dioxide copolymer-polyamine ("Polyflo"-130) composition of the type described in U.S. Pat. No. 3,917,466.

Composition 7 is a 1-decene/sulfur dioxide copolymer having a molecular weight of 200,000 to 500,000 of the type described in U.S. Pat. No. 4,029,480.

Composition 8 has the general formula

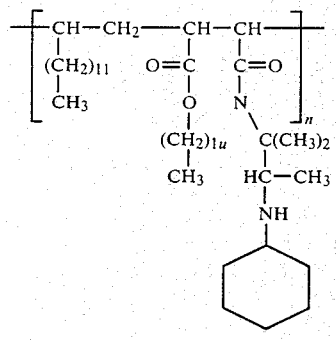

Composition 9 comprises equal parts of the following three active materials in xylene as a carrier:

(a) The chromium salt of alkyl salicylic acid.

(b) The calcium salt of Di-decyl sulfo succinic acid, and (c) A methacrylate-vinyl pyridine copolymer of the type described in Canadian Pat. No. 655,597.

TABLE I

Fuel: Kerosene

| Test No. | Additive(s) | Conductivity (ps/m) @ 76° F. |
|---|---|---|
| 1 | none | 5 |
| 2 | Ex. 5 @ 2 ppm | 35 |
| 3 | Ex. 5 @ 4 ppm | 60 |

TABLE I-continued

Fuel: Kerosene

| Test No. | Additive(s) | Conductivity (ps/m) @ 76° F. |
|---|---|---|
| 4 | Ex. 1 @ 2 ppm | 5 |
| 5 | Ex. 1 @ 4 ppm | 5 |
| 6 | Ex. 5 @ 2 ppm plus Ex. 1 @ 2 ppm | 80 |
| 7 | Ex. 2 @ 2 ppm | 10 |
| 8 | Ex. 2 @ 4 ppm | 15 |
| 9 | Ex. 5 @ 2 ppm plus Ex. 2 @ 2 ppm | 280 |
| 10 | Ex. 8 @ 2 ppm | 10 |
| 11 | Ex. 8 @ 4 ppm | 10 |
| 12 | Ex. 8 @ 2 ppm plus Ex. 2 @ 2 ppm | 30 |
| 13 | Ex. 6 @ 2 ppm | 410 |
| 14 | Ex. 6 @ 4 ppm | 1000 |
| 15 | Ex. 6 @ 2 ppm plus Ex. 2 @ 2 ppm | >1000 |
| 16 | Ex. 7 @ 2 ppm plus Ex. 2 @ 2 ppm | 810 |

TABLE II

Fuel: No. 1 Fuel Oil

| Test No. | Additive(s) | Conductivity (ps/m) @ 72° F. |
|---|---|---|
| 1 | none | 4 |
| 2 | Ex. 5 @ 6 ppm | 90 |
| 3 | Ex. 1 @ 15 ppm | 22 |
| 4 | Ex. 5 @ 6 ppm plus Ex. 1 @ 15 ppm | 300 |

TABLE III

Fuel: No. 1 Fuel Oil

| Test No. | Additive(s) | Conductivity (ps/m) @ 72° F. |
|---|---|---|
| 1 | none | 5 |
| 2 | Ex. 6 @ 1 ppm | 240 |
| 3 | Ex. 6 @ 1 ppm plus Ex. 1 @ 15 ppm | 400 |
| 4 | Ex. 9 @ 0.5 ppm | 160 |
| 5 | Ex. 9 @ 0.5 ppm plus Ex. 1 @ 15 ppm | 200 |

TABLE IV

Fuel: Kerosene

| Test No. | Additive(s) | Conductivity (ps/m) @ 78° F. |
|---|---|---|
| 1 | none | 5 |
| 2 | Ex. 5 @ 5.ppm | 80 |
| 3 | Ex. 5 @ 5 ppm plus Ex. 1 @ 5 ppm | 280 |
| 4 | Ex. 5 @ 5 ppm plus Ex. 2 @ 5 ppm | 760 |
| 5 | Ex. 5 @ 5 ppm plus Ex. 3 @ 5 ppm | 125 |
| 6 | Ex. 5 @ 5 ppm plus Ex. 4 @ 5 ppm | 180 |
| 7 | Ex. 2 @ 5 ppm | 20 |

TABLE V

Fuel: Kerosene

| Test No. | Additive | Conductivity (ps/m) @ 72° F. |
|---|---|---|
| 1 | none | 5 |
| 2 | Ex. 1 @ 15 ppm | 40 |

TABLE VI

Fuel: No. 2 Diesel Fuel

| Test No. | Additive | Conductivity (ps/m) @ 74° F. |
|---|---|---|
| 1 | none | 10 |
| 2 | Ex. 1 @ 15 ppm | 30 |

TABLE VII

Fuel: No. 2 Fuel Oil

| Test No. | Additive(s) | Conductivity (ps/m) @ 74° F. |
|---|---|---|
| 1 | none | 16 |
| 2 | Ex. 5 @ 1.5 ppm | 140 |
| 3 | Ex. 1 @ 15 ppm | 24 |
| 4 | Ex. 5 @ 1.5 ppm plus Ex. 1 @ 15 ppm | 170 |

TABLE VIII

Fuel: Diesel Fuel

| Test No. | Additive(s) | Conductivity (ps/m) @ 72° F. |
|---|---|---|
| 1 | none | 10 |
| 2 | Ex. 5 @ 3 ppm | 120 |
| 3 | Ex. 1 @ 15 ppm | 20 |
| 4 | Ex. 5 @ 3 ppm plus Ex. 1 @ 15 ppm | 240 |

TABLE IX

Fuel: No. 2 diesel

| Test No. | Additive(s) | Conductivity (ps/m) @ 70° F. |
|---|---|---|
| 1 | none | 15 |
| 2 | Ex. 5 @ 6 ppm | 95 |
| 3 | Ex. 5 @ 6 ppm plus Ex. 1 @ 15 ppm | 300 |

TABLE X

Fuel: No. 2 diesel

| Test No. | Additive(s) | Conductivity (ps/m) @ 70° F. |
|---|---|---|
| 1 | none | 15 |
| 2 | Ex. 5 @ 6 ppm | 100 |
| 3 | Ex. 1 @ 15 ppm | 120 |
| 4 | Ex. 5 @ 6 ppm plus Ex. 1 @ 15 ppm | 250 |

TABLE XI

Fuel: Kerosene

| Test No. | Additive | Conductivity (ps/m) @ 72° F. |
|---|---|---|
| 1 | none | 5 |
| 2 | Ex. 1 @ 15 ppm | 120 |

TABLE XII

Fuel: JP-4 Turbine Fuel

| Test No. | Additive | Conductivity (ps/m) @ 72° F. |
|---|---|---|
| 1 | none | 5 |
| 2 | Ex. 1 @ 15 ppm | 50 |

TABLE B

| Composition Ex. | Composition of Demulsifiers employed Tables XIII to XV |
|---|---|
| A | oxyethylated acid-catalyzed t-butyl phenol/nonyl phenol/formaldehyde resin |
| B | oxyethylated base-catalyzed t-butyl phenol/nonyl phenol/formaldehyde resin |
| C | oxyethylated base-catalyzed nonyl phenol/formaldehyde resin |
| D | oxyethylated base-catalyzed nonyl phenol/dinonyl phenol/formaldehyde resin |
| E | oxyethylated/oxypropylated acid-catalyzed t-butyl phenol/formaldehyde resin |
| F | oxyethylated/oxypropylated base-catalyzed t-butyl/nonyl phenol/formaldehyde resin |
| G | oxypropylated/oxyethylated acid-catalyzed t-amyl phenol/formaldehyde resin |
| H | oxypropylated/oxyethylated base-catalyzed t-amyl phenol/formaldehyde resin |
| I | oxypropylated/oxyethylated base-catalyzed t-amyl phenol/formaldehyde resin |
| J | oxyethylated acid-catalyzed t-amyl phenol/formaldehyde resin |
| K | oxyethylated acid-catalyzed nonyl phenol/dinonyl phenol/formaldehyde resin |
| L | oxyethylated base-catalyzed t-amyl phenol/formaldehyde resin |
| M | oxyethylated/oxypropylated base-catalyzed t-butyl phenol/formaldehyde resin |
| N | oxyethylated/oxypropylated acid-catalyzed t-amyl phenol/formaldehyde resin |
| 0 | oxypropylated/oxyethylated base-catalyzed t-butyl phenol/formaldehyde resin |
| P | oxypropylated/oxyethylated acid-catalyzed nonyl phenol/formaldehyde resin |
| Q | oxypropylated/oxyethylated acid-catalyzed nonyl phenol/dinonyl phenol/formaldehyde resin |
| R | oxypropylated/oxyethylated acid-catalyzed t-butyl phenol/formaldehyde resin |

TABLE XIII

| | Fuel: Kerosene (Conductivity 5 ps/m) Conductivity (picosiemens/meter) | | | |
|---|---|---|---|---|
| Test | Component A Composition from Table B, Ex. | With 2 ppm Component A | With 2 ppm Component B (Composition from Table A Ex. 5) | With 2 ppm Component A and 2 ppm Component B |
| 1 | A | 10 | 35 | 110 |
| 2 | B | 50 | 35 | 190 |
| 3 | C | 10 | 35 | 250 |
| 4 | D | 5 | 35 | 150 |
| 5 | E | 5 | 35 | 100 |
| 6 | F | 15 | 35 | 70 |
| 7 | G | 10 | 35 | 60 |
| 8 | H | 10 | 35 | 140 |
| 9 | I | 10 | 35 | 70 |
| 10 | J | 5 | 35 | 50 |
| 11 | K | 25 | 35 | 130 |
| 12 | L | 10 | 35 | 35 |
| 13 | M | 5 | 35 | 100 |

TABLE XIII-continued

| | Fuel: Kerosene (Conductivity 5 ps/m) Conductivity (picosiemens/meter) | | | |
|---|---|---|---|---|
| Test | Component A Composition from Table B, Ex. | With 2 ppm Component A | With 2 ppm Component B (Composition from Table A Ex. 5) | With 2 ppm Component A and 2 ppm Component B |
| 14 | N | 5 | 35 | 50 |
| 15 | 0 | 5 | 35 | 50 |
| 16 | P | 5 | 35 | 100 |
| 17 | Q | 5 | 35 | 50 |
| 18 | R | 5 | 35 | 40 |

TABLE XIV

| | Fuel: Kerosene | | |
|---|---|---|---|
| Test | Additive Composition Ex. | Conc. (v/v ppm) | Conductivity (ps/m) at 70° F. |
| | none | — | 2 |
| 1 | A | 20 | 26 |
| 2 | B | 10 | 39 |
| 3 | C | 20 | 120 |
| 4 | F | 20 | 15 |
| 5 | K | 20 | 80 |

TABLE XV

| | Fuel: Kerosene | |
|---|---|---|
| Additive(s) Composition Ex. | Conc. (v/v ppm) | Conductivity (ps/m) at 76 to 78° F. |
| none | — | 5 |
| AN/O* | 2 | 25 |
| AN/O | 4 | 30 |
| C | 2 | 10 |
| C | 4 | 15 |
| AN/O + C | 2 + 2 | 450 |

*An acrylonitrile/olefin copolymer (AN/O)

We claim:

1. An antistatic composition comprising an oxyalkylated phenol-aldehyde resin and an antistatic agent other than a surfactant.

2. An organic fluid containing the composition of claim 1 in an amount sufficient to impart antistatic properties to said fluid, said fluid being one of low electrical conductivity in the absence of said composition.

3. A volatile and ignitable or explosive organic liquid of low electrical conductivity containing the composition of claim 1 in an amount sufficient to impart antistatic properties to said liquid.

4. A volatile and ignitable or explosive hydrocarbon liquid containing the composition of claim 1 in an amount sufficient to impart antistatic properties to said liquid.

5. A composition comprising a petroleum distillate fuel oil having an initial boiling point of from 75° F. to about 135° F. and an end boiling point from about 250° F. to about 1000° F. and from 0.1 to 100 ppm. of an oxyalkylated phenol-aldehyde resin serving as an antistatic agent.

6. A composition comprising a light hydrocarbon solvent and from 0.1 to 100 ppm. of an oxyalkylated phenol-aldehyde resin serving as an antistatic agent.

* * * * *